United States Patent [19]

Townsend

[11] Patent Number: 4,881,381

[45] Date of Patent: Nov. 21, 1989

[54] TEXTILE FABRIC

[76] Inventor: Irving Townsend, 11910 Mayfield Ave., Los Angeles, Calif. 90049

[21] Appl. No.: 286,693

[22] Filed: Dec. 20, 1988

[51] Int. Cl.[4] ..... D04B 35/00

[52] U.S. Cl. ..... 66/1 A; 66/4; 66/193; 28/149

[58] Field of Search ..... 66/1 A, 4, 193; 28/149, 28/150, ; 139/29, 34

[56] References Cited

U.S. PATENT DOCUMENTS 4,081,885 4/1978 Shank ..... 28/149

4,425,398 1/1984 Berczi ..... 66/193

*Primary Examiner*—Henry S. Jaudon

*Attorney, Agent, or Firm*—Albert O. Cota

[57] ABSTRACT

A method of forming a textile fabric using a frame (20) which has pegs (22) spaced apart around the perimeter with yarn wound a first direction (26) between parallel pegs forming a warp. Yarn is then wound a second direction (28) 90-degrees from the first directly on top creating a woof-like layer, but not interlaced. Yarn is crocheted in a chain stitch a first (30) and a second (32) diagonal or right-angled direction across the frame tying the warp and woof layers together into a fabric. Yarn is finally crocheted in a chain stitch through the perimeter of the textile joining the edges together into interlocked loops that will not unravel. The fabric is then removed from each peg by pulling the yarn upwardly off the peg by means of a crochet hook. The finished product results in a strurdy fabric having geometrical or other design patterns.

7 Claims, 1 Drawing Sheet

TEXTILE FABRIC

TECHNICAL FIELD

The present invention relates, to textiles in general, more specifically to a fabric having layers of yarn held together by crocheting, linking several different parallel directions, and also around the perimeter.

BACKGROUND ART

The weaving of individual strands of yarn or thread into a textile or fabric is as old as antiquity itself. Most weaving today is accomplished by interlacing yarns, particularly by the use of a loom where a group of parallel yarns, or warp, is interwoven using a shuttle creating a woof or crossways threads laced over and under. A myriad of variations create different patterns in the surface of the textile. So-called triaxial weaving introduces a third end into the weaving process with two warp ends and one filling end interlocked at a 60 degree angle.

Crocheting is also old and well known in the art and uses a technique similar to knitting with a single strand. The process loops a single yarn or thread into a chain by means of a rug nook or a crochet hook.The hook is cylindrical, having a barb-like hook on one end. A loop of thread is hooked over and under the wound yarn by pulling the yarn through the loop with the hook in a crocheting fashion. Crocheting may be ccomplished with a machine, however, it is usually performed by hand.

Frames with pins or pegs on the perimeter are also known in the art. These frames are used to guide thread or yarn in a particular direction and to wind around forming parallel rows or matrixes.

DISCLOSURE OF THE INVENTION

While the above methods of making fabric and knitting, or crocheting, with a hook have been in existence for a very long time, the need to produce a new fabric with unique features and distinctive tactile quality is always present. This invention is directed to that end, consisting of arranging parallel crossed layers of yarns combined with diagonal or right-angled crocheting completely through the parallel crossed layers producing a completely different appearing textile.

A primary object of the invention is directed to the ability of the maker to produce the article by hand five to ten times faster than hand weaving or hand knitting or crocheting. The reason is that the first two to five layers are simply wound around pegs on a frame in a given direction, which is an extremely fast method of laying up the yarn. The hand crocheting does require some skill to become proficient as far as speed is concerned, however, since the amount of hand crocheting is still only a small portion of the area and it is spaced apart materially, the entire process is by far faster to produce than comparable hand made textiles. Obviously, the same would be true with machine processes due to its simplicity and speed.

An important object of the invention is the three dimentional quality of the completed fabric, as the crocheting is spaced apart sufficiently to allow the flat contiguous layers thereunder to be seen and give depth to the fabric. All of the layers may be visually defined and, yet, are not distinct by themselves. The fact that the sides are different also adds to the depth perception, as the front side of the chain stitch crocheting forms a double row of yarn in a series of loops and the back is in a single line, both allowing the layers underneath to be clearly seen.

Another object of the invention deals with the light weight qualities of the textile, due to the wide spacing and layering of the yarn. This object is achieved by using a large diameter peg on the frame and wide spacing therebetween. The weight is also easily changed, by not only changing peg side and spacing, but also the number of strands of yarn per winding and, further, the number of wound layers.

Still another object of the invention allows the woven fabric to be warm, as the loosely fabricated material includes an abundance of dead air spaces and voids. Further, this process produces fabric much thicker than conventional weaving, knitting or crocheting for equivalent number of threads in a given area.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred, second and third embodiments. All three embodiments are primarily designed the same, except for the number of winding layers or crocheting directions.

Figure 1:
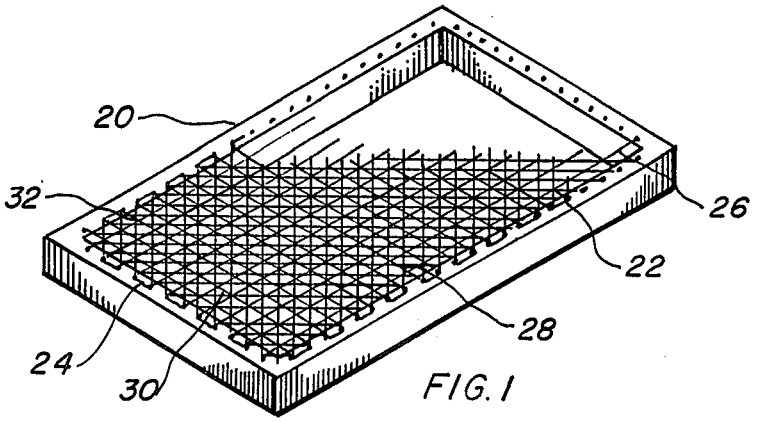
FIG. 1 is a partial isometric view of the preferred embodiment illustrating the frame partially wound and with the layers and crocheting cut-away to illustrate the winding and crocheting process.
Figure 2:
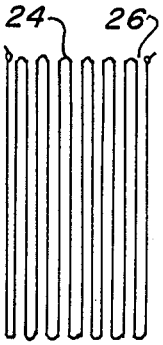
FIG. 2 is a plan view of the first direction of yarn forming the warp completely removed from the invention for clarity.
Figure 3:
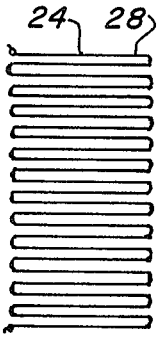
FIG. 3 is a plan view of the second direction of yarn, relative to the first, forming a woof like layer completely removed from the invention for clarity.

The preferred embodiment, as shown in FIGS. 1 through 7 is comprised of the steps of winding yarn on a frame 20 having a plurality of pegs 22 at equally spaced intervals around the perimeter. The frame may be any shape, round, square, polygonal, oval, or rectangular, etc., as illustrated in FIG. 1, with no particular limitations as to size or even configuration. The pegs 22 may also be of any size and diameter depending upon the thickness of the yarn used and density of the desired pattern. The closer the pegs, the tighter and more dense the fabric and, likewise, the smaller the diameter of the peg yields a tighter configuration. The pegs 22 may be either straight or angled with a 100 to 115 degree obtuse angle relative to the frame being preferred. The frame 20 is well known in the art by itself and may be made of any material suitable for the purpose, such as wood, metal, thermoplastic, composition board, and the like. The pins 22, likewise, may be fabricated of the same materials as the frame 20, or any combination thereof, such as wood dowels into a wood frame, or nails into composition board, etc.

The yarn 24 used in the weaving process, again, is not limited to any particular type of material, diameter, number of strands, color, texture, etc., or even the same material throughout the forming process, as various combinations may be used to purposely change the pattern, density, and thickness of the finished textile.

The method of forming the textile consists of the steps of winding yarn 24 in a given direction around each of a number of adjacent parallel pegs 22. For clarity, the initial layer may be designated the first direction 26, preferable the long way if the frame 20 happens to be rectangular. The first direction 26 may be also called the warp, as it now defines a number of parallel threads lengthwise in a loom. The first wound direction 26 or warp is illustrated by itself in FIG. 2 and in its relative position in FIGS. 7 through 9 in other embodiments. The winding consists of tying the yarn to the first peg 22 and looping around the peg directly across at a 90 degree angle from the starting side and returning to the peg next to or adjacent on the side and continue winding back and forth until all of the parallel pegs are wrapped.

The second direction 28 is exactly like the first, except 90 degrees apart and if rectangular on the short sides of the frame 20. This winding continues around the remaining pegs 22 until all of the pegs are filled and a woof-like layer is now formed on top of the warp, however, they are not interlaced, as in weaving, instead just contiguously resting on each other. The second direction 28 is also shown removed from other layers by itself in FIG. 3 and again in its relative position in FIGS. 7 through 9.

Figure 4:
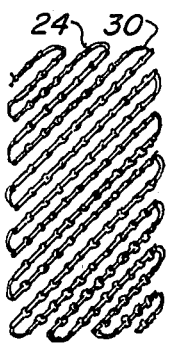
FIG. 4 is a plan view of the first diagonal direction of the crocheting relative to FIGS. 2 and 3 completely removed from the invention for clarity.
Figure 5:
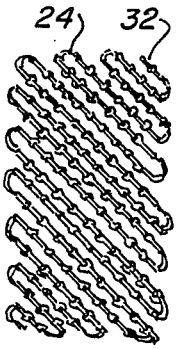
FIG. 5 is a plan view of the second diagonal direction of the crocheting relative to FIGS. 2 through 4 completely removed from the invention for clarity.
Figure 6:
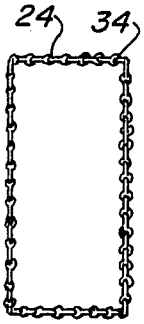
FIG. 6 is a plan view of the crocheting on the perimeter relative to FIGS. 2 through 5 completely removed from the invention for clarity.
Figure 7:
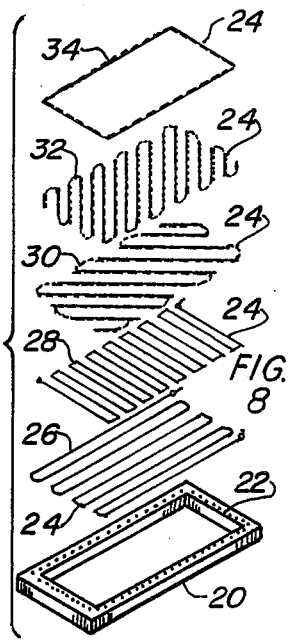
FIG. 7 is an exploded view of the preferred embodiment with five separate layers or processes.

The next step in the method of producing the textile fabric is to crochet yarn in a chain stitch a first diagonal direction 30, as shown in FIG. 4, by itself. The yarn may be tied to a peg 22 in a corner then crocheted a diagonal direction along two nonadjacent vertices of the frame to an opposite peg where it is looped over then continued crocheting diagonally across until the entire area is traversed. The crocheting chain stitch is well known in the art and is accomplished using a crochet hook that is commercially available and is made by placing a loop of yarn upon the hook then winding over the hook through the layered winding 26 and 28 and drawn through the loop with the hook on the end. This method is basically a loop connected to another loop in sequence with the layered windings fastened therebetween. This process connects the layers together by the chain stitch crocheting and also serves another purpose by adding to the appearance, as each side is, therefore, different with a double loop visible on one side and only a single strand of yarn on the other.

The preferred embodiment includes crocheting yarn in a chain stitch a second diagonal direction 32 some 90 degrees from the first, 30, also around adjacent pegs along two nonadjacent vertices of the frame in the same manner crossing each first direction 30 creating a diamond pattern. The second direction 32 may be either on the same side or opposed according to the desired pattern.

The fabric is then completed by crocheting yarn in a chain stitch completely through and around the perimeter 34 of the above layers and crocheting, thereby joining the edge into a sturdy fabric. The perimeter crocheting 34 binds the edges firmly with the last step removing the fabric from the frame 20 by pulling the loops upward from the pegs. Another method of applying the final perimeter crocheting 34 is to remove the fabric from the frame first, then apply the perimeter crocheting allowing the connecting work to be closer to the outside edge than allowed in the frame.

Figure 8:
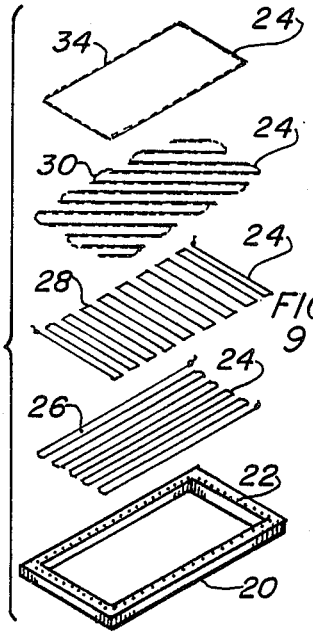
FIG. 8 is an exploded view of the second embodiment with four separate layers or processes.

The second embodiment is exactly the same as the first, except the second crocheting a diagonal direction 32 is eliminated. This embodiment is illustrated in FIG. 8 and is the simplest to fabricate, however, it is not as thick and does not have the diamond design created by the two diagonal crocheting directions 30 and 32.

Figure 9:
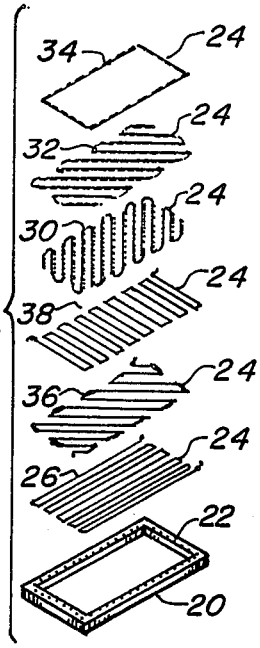
FIG. 9 is an exploded view of the third embodiment with six separate layers or processes in their relative position.

The third embodiment is depicted in FIG. 9 and consists of exactly the same process as in the preferred embodiment, except winding yarn a second diagonal direction 36 across the frame 20 around adjacent pegs along two nonadjacent vertices forming a contiguous layer replace the woof-like layer 28. Further, an additional layer which is winding yarn a third direction 38, at least 90 degrees from the first 26 around each of the remaining adjacent parallel pegs 22 forms a woof-like layer on top of the second layer 36. This third woof-like layer 38 is identical to the second layer 28 of the first and second embodiments, only the order has changed with the addition of the diagonal layer 36 in between the woof 26 and the warp 28 layers. This third embodiment simply increases the thickness and density of the fabric giving greater body and warmth to the to the material.

It will be noted that in all three embodiments the steps of winding and crocheting remain the same, only the number of layers change, making the difference this same procedural variation may be used with equal ease, while still not departing from the scope of this invention. In the same light, further crocheting in parallel stitches may be added, not unlike the diagonal crocheting 30 and 32 to create a variation in pattern to enhance the decorative quality of the textile. This additional variation may be any direction, as long as they are parallel and continue through the fabric. The angular relationship from any side of the frame is also optional, as the purpose of this additional crocheting is only to create decorative designs on top of the fabric.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. The method of forming a fabric, a textile fabric using a frame having a plurality of pegs at equally spaced intervals around the perimeter threof which comprise the steps of:

(a) winding yarn a first direction around each of a number of adjacent parallel pegs forming a warp;

(b) winding yarn a second direction 90 degrees from the first around each of the remaining adjacent parallel pegs forming a woof-like layer on top of said warp;

(c) crocheting yarn in a chain stitch a first diagonal direction across the frame around adjacent pegs along two nonadjacent vertices through the woof-like layer and warp layer simultaneously;

(d) crocheting yarn in a chain stitch a second diagonal direction 90 degrees from the first around adjacent pegs along two nonadjacent vertices in the same manner as the first diagonal crocheting; and, crocheting yarn in a chain stitch through the perimeter of the thus formed textile joining the edge of the wound and crocheted yarn into a substantial sturdy fabric creating tactile depth with a patterned surface.

2. The method of forming a fabric as recited in claim 1 further comprising the steps of crocheting a plurality of parallel stitches through the fabric to create a variation in pattern to enhance the decorative quality.

3. The method of forming a fabric as recited in claim 1 wherein said step of crocheting yarn in a chain stitch is accomplished at right angles with respect to the frame.

4. A method of forming a textile fabric using a frame having a plurality of pegs at equally spaced intervals around the perimeter thereof which comprise the steps of:

(a) winding yarn a first direction around each of a number of adjacent parallel pegs forming a warp;

(b) winding yarn a second direction 90 degrees from the first around each of the remaining adjacent parallel pegs forming a woof-like layer on top of said warp;

(c) crochet yarn in a chain stitch a third direction unlike that of the warp and woof-like layer direction around adjacent pegs through the warp and woof-like layer simultaneously; and, (d) crocheting yarn in a chain stitch through the perimeter of the thus formed textile joining the edge of the wound and crocheted yarn into a substantial sturdy fabric creating tactile depth with a patterned surface.

5. The method of forming a fabric as recited in claim 4 further comprising the steps of crocheting a plurality of parallel stitches through the fabric to create a variation in pattern to enhance the decorative quality.

6. A method of forming a textile fabric using a frame having a plurality of pegs at equally spaced intervals around the perimeter thereof which comprise the steps of:

(a) winding yarn a first direction around each of a number of adjacent parallel pegs forming a warp;

(b) winding yarn a second diagonal direction across the frame around adjacent pegs along two nonadjacent vertices forming a contiguous layer with the first winding;

(c) winding yarn a third direction 90 degrees from the first around each of the remaining adjacent parallel pegs forming a woof-like layer on top of said second winding layer;

(d) crocheting yarn in a chain stitch a first diagonal direction across the frame around adjacent pegs along two nonadjacent vertices through all of the layers simultaneously;

(e) crocheting yarn in a chain stitch a second diagonal direction 90 degrees from the first around adjacent pegs along two nonadjacent vertices in the same manner as the first diagonal crocheting.

7. The method of forming a fabric as recited in claim 6 further comprising the steps of crocheting a plurality of parallel stitches through the fabric to create a variation in pattern to enhance the decorative quality.

* * * * *